United States Patent [19]

Maier et al.

[11] Patent Number: 4,757,953

[45] Date of Patent: Jul. 19, 1988

[54] REEL SUPPORT AND PROCESS FOR USE OF SAME IN CONJUNCTION WITH A ROTATING-ROLLING PRINTING PRESS

[75] Inventors: Peter Maier, Worms; Arnold Niedermaier, Beindersheim, both of Fed. Rep. of Germany

[73] Assignee: Albert-Frankenthal AG, Frankenthal, Fed. Rep. of Germany

[21] Appl. No.: 48,043

[22] Filed: May 11, 1987

[30] Foreign Application Priority Data

May 30, 1986 [DE] Fed. Rep. of Germany ..... 3618281

[51] Int. Cl.[4] ..... B65H 16/06; B65H 18/04

[52] U.S. Cl. ..... 242/68.4; 242/68.5; 242/57

[58] Field of Search ..... 242/68.2, 68.3, 68.4, 242/68, 68.5, 68.6, 57; 428/902

[56] References Cited

U.S. PATENT DOCUMENTS

| | | | |
|---|---|---|---|
| 3,447,674 | 7/1967 | Fraser | 242/68.5 |
| 4,191,342 | 3/1980 | Reinhold | 242/68 |
| 4,254,918 | 3/1981 | Huggins | 242/68.5 |

*Primary Examiner*—John M. Jillions
*Assistant Examiner*—Steven M. duBois
*Attorney, Agent, or Firm*—Edwin D. Schindler

[57] ABSTRACT

In a reel support with devices which preferably are in the form of pins able to be moved in and out, and serve to accommodate at least one reel of paper or the like which is wound on a central shell made of cardboard or the like and from which a strip of paper can be unwound, a bursting of the cardboard shell can be reliably prevented and a smooth running achieved by inserting into the cardboard shell a crossbeam which suitably is in the form of a pipe made of carbon filament reinforced plastic.

20 Claims, 1 Drawing Sheet

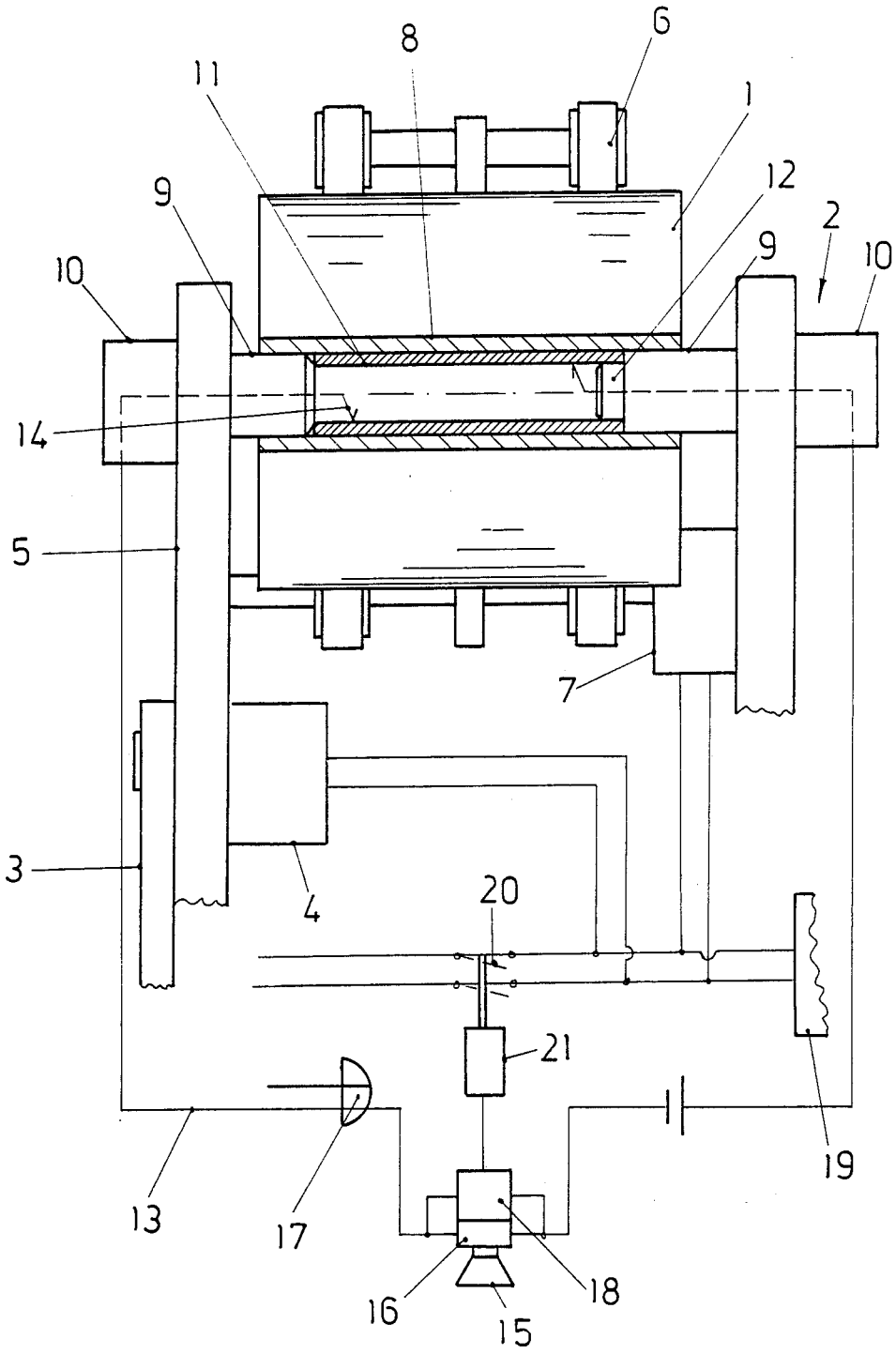
6
8
11
1
12
9
2
9
10
10
14
5
7
3
4
20
21
19
13
17
16
18
15

REEL SUPPORT AND PROCESS FOR USE OF SAME IN CONJUNCTION WITH A ROTATING-ROLLING PRINTING PRESS

BACKGROUND OF THE INVENTION

The present invention relates to a reel support with devices which preferably are in the form of pins able to be moved in and out, and serve to accommodate at least one reel of paper or the like which is wound on a central shell made of cardboard or the like and from which a strip of paper can be unwound.

During the unwinding process resonance phenomena have been experienced with the composite beam, which practically is formed by the cardboard shell and the reel stump, and sags due to its own weight, passing its own critical speed of rotation. The result thereof, in particular when longer reels are in use, is an unsteady running, which in any case can lead to register faults, faulty glueing of the strip running out to the fresh reel, as well as tearing of the strip. In many cases, the cardboard shell even bursts with possible fatal results for the operating crew as well as great danger of destruction.

It has been tried to solve these problems by using steel cores instead of cardboard shells. However, this method has not provided efficient so far as the steel cores have to be brought back from the paper processing plant to the paper producing plant. This causes high costs of transport whereas the cardboard shells can be economically disposed of. Furthermore, when using steel cores resonance phenomena cannot be completely excluded, which due the high stability of steel does not lead to a bursting but nevertheless to an unsteady running.

SUMMARY OF THE INVENTION

Taking this prior art into account, it is therefore the object of the invention to improve the previously mentioned design with simple and low-cost means so as to not only definitely avoid bursting when shells made of cardboard or the like are use, but also guarantee a relatively smooth running.

In order to effect this object, a crossbeam with a modulus of elasticity similar to that of steel and a relatively low own weight, i.e. about 4.5 to 6.5 times lower, is inserted into the shell.

A crossbeam of this kind does not pass its own critical speed of rotation with the speeds of rotation resulting from the speeds of the strip which are in current use nowadays. The present design therefore makes sure that there are no resonance phenomena in relation to the crossbeam. If the cardboard shell or respectively the composite beam formed by the cardboard shell and the reel stum accommodated thereon reaches the resonant range, the cardboard shell can rest on the crossbeam not reaching the resonant range, which not only prevents the danger of bursting, but also reduces the deflections of the vibration of the cardboard shell and the reel stump accommodated thereon, and therefore adds to a general smooth operation. The invention also guarantees a limitation of the costs asked for as the crossbeam not only remains intact and can therefore be used as a spare part again and again, but can also be put into and out of the operating position in an easy and simple way.

As part of a convenient further development of the invention, the crossbeam can be made of carbon filament reinforced plastic. This material offers the advantage of a relatively low own weight, about 5.5 times lower than that of steel, and a high modulus of elasticity which is approximately the same as that of steel. At the same time, the said material conducts electricity due to the carbon incorporation and can therefore be conveniently included as an electrical bridge in a safety switching network which, in its interrupted state, i.e. when the stiffening element is missing, passivates the drive of the reel support and/or the acceleraton drive of the reel and/or the drive of the successive printing press. This makes sure that the stiffening element cannot simply be left out and therefore guarantees a high safety.

With the crossbeam missing, it is convenient to have a signal device first and a switching-off device at a certain delay thereto which can be activated by means of the switching network containing the crossbeam as a bridge. This design has the advantageous effect of preventing stand-stills and therefore improving the economy.

In accordance with a further development of the invention, the crossbeam can have a shifting clearance in relation to the shell of about 0.5 millimeter. On one hand, this design enables the crossbeam to move in and out easily, and on the other hand also guarantees a firm rest of the shell on the crossbeam.

As part of another convenient development of the invention, the crossbeam can be in the form of a pipe. This not only leads to cutting down on material costs but at the same time also enables the crossbeam to be easily centered by means of pivots molded onto the pins.

Further useful effects of the invention and convenient outgrowths thereof will be seen from the following detailed account of one working example described with reference to the accompanying drawing.

The only FIGURE of the drawing is a partly sectional, schematic view of a reel support.

DETAILED ACCOUND OF WORKING EXAMPLE OF THE INVENTION

For producing products of the press in a not specified roller rotary printing press the latter is supplied with a strip of paper unwound from paper reels 1 which are operated successively and can be accommodated on a reel support 2 preceding the roller rotary printing press. Several kinds of reel supports are known. The reel support 2 shown in the drawing consists of a swivel frame 5 which is turningly bearinged on a support 3, can be driven by means of a swivel motor 4, and has devices for accommodating two reels 1 at a time, i.e. one turning in action and a fresh one. However, designs without swivel frames are also possible.

While a turning reel is used up a fresh reel is already put into position. This reel is accelerated to the speed of the strip by means of acceleration belts 6 which can be brought into driving contact with the circumference of the said reel and driven by means of a cooperating acceleration motor 7. Then the strip running off from the used-up reel is cut and glued to the beginning of the strip situated on the fresh reel. For this purpose there are usually stickers at the beginning of the strip, which make the required connection when the appropriate pressure contact is established. For reasons of simplicity only one reel 1 is shown in the drawing.

The reel 1 contains a core 8, which here is in the form of a cardboard shell or the like, and to which the strip of paper is wound on in several layers. The devices for accommodating each reel are formed by two pins 9 which are located opposite each other, and can be moved into and out of the shell-like core 8. For this purpose the pins 9 are supported such as to be movable in axial direction, and can be shifted by means of a clamping element 10 as for example in the form of a cylinder piston unit. The pins 9 can be slightly conical shape.

In order to achieve a smooth running even in the resonant range of the shell-like core 8 or respectively the composite beam formed by the core 8 and the reel stump still accommodated thereon, a crossbeam 11 is inserted into the core 8, which here is in the form of a cardboard shell. The said crossbeam 11 is designed such as not to reach its resonant range with the rate of revolutions resulting from the speed of the strip to be expected. For this purpose, a material is used for making the crossbeam 11 of which the modulus of elasticity approximately corresponds to the one of steel, but which has a relatively lower own weight than steel, i.e. approximately 4.5 to 6.5 times lower. In this respect, carbon filament reinforced plastic has proved to be a particularly suitable material with a modulus of elasticity similar to that of steel and an own weight about 5.5 times lower than steel so that high bearing and vibration-proof characteristics are the result. The crossbeam 11 can be in the form of a rod made of solid material. In the working example shown here, the crossbeam 11 is in the form of a pipe with a wall thickness in the range of some millimeters, which makes sure that little material is needed and a great rigidity of shape is achieved at the same time.

The outer diameter of the crossbeam 11 corresponds to the inner diameter of the shell-like core 8 minus a displacement clearance which can be in the range of 0.5 millimeter. This makes sure that on one hand the crossbeam 11 can be moved easily and simply into and out of the hole of the shell-like core 8, and that on the other hand the core 8 in the form of a cardboard shell is nevertheless sufficiently stiffened. The crossbeam 11 is of such length that the engagement of the pins 9 into the core 8 is not impeded. Therefore the crossbeam 11 is of shorter length that the core 8 and that by at least the length of engagement of the pins 9. In the working example shown here, the crossbeam 11 is of such length that the pins 9 in their end position are in a pressure-free contact with the ends of the crossbeam 11. This guarantees a location of the crossbeam 11 by the pins 9 symmetrical to the center longitudinal plane of the machine so that exactly symmetrical conditions are the result. The pins 9 can simply butt on the crossbeam 11 as shown in the example of the left pin. However, it would also be feasible to center the crossbeam 11 by means of the pins 9. As shown in the example of the right pin, the pins 9 for this purpose can simply have a respective spigot 12 engaging into a respective hole which is there automatically in the case of a pipe-like crossbeam 11.

The crossbeam 11 is inserted into the fresh reel before the latter is accommodated on the reel support 2 and for further use taken out again of the used-up reel after removing the latter from the reel support. In order to prevent a non-use of the crossbeam 11 for reasons of laziness or the like, there is a safety device of such design that, when a reel 1 without a crossbeam 11 has been put into the reel support 2 and is to be brought into operating position, there is first a warning signal and after a certain amount of time the entire reel support 2 and/or also the successive printing press is then inactivated. In the working example shown here, the crossbeam 11 is for this reason in the form of an electricity conducting bridge, which due to the carbon incorporation is the case anyway when carbon filament reinforced plastic is used. However, it would also be feasible to arrange for a separate laddered circuit in the crossbeam 11. In its operating condition the said bridge is in conducting contact with the ends of the two branches of a switching network 13, which here is in the form of a low-voltage circuit. This can be achieved by a direct contact of the crossbeam 11 or respectively the bridge put thereon with the pins 9 if the latter are made of electricity conducting material and are included in to the switching network 13. In the working example shown here, the electricity conducting connection of the crossbeam 11 with the two branches of the switching network 13 is clearly indicated by leads running via the pins 9, and contacts 14 which are fixed thereto and rest on the inner circumference of the pipe-like crossbeam 11. The switching network 13 runs via an actuating element 16 which cooperates with the energy supply to a horn 15 and is designed such as to give a warning signal if, with the swivel drive 4 or respectively the acceleraton drive 7 activated, the switching network 13 is without electricity, i.e. if there is no bridge formed by the crossbeam 11. This, for example, can be achieved by means of a so-called UND-gate 17. Parallel to the actuating element 16 there is a retarding element 18, by means of which an actuating element 21 can be controlled which cooperates with an interrupter 20 located in the energy supply line leading to the swivel drive 4 and/or the accelertion drive 7 and/or the drive 19 of the printing press. This makes sure that, when the warning signal given by the horn 15 because of the crossbeam 11 missing is not noticed, the reel support 2 and/or the successive printing press can be passivated. The pre-warning by means of a horn 15 or the like enables the mistake still to be corrected without further consequences before the reel support 2 and/or the printing press are/is stopped.

We claim:

1. In a reel support with devices which are in the form of pins and able to be moved in and out, which serve to accommodate at least one reel of paper, or the like, and which is wound on a central shell made of cardboard or the like, from which a strip of paper is capable of being unwound, the improvement comprises:

a crossbeam having a modulus of elasticity similar to that of steel and having a weight which is approximately 4.5 to 6.5 times lower than would be the weight of steel having a similar mass, said crossbeam being capable of insertion into said shell.

2. A reel support as claimed in claim 1 wherein the crossbeam is made of carbon filament reinforced plastic.

3. A reel support as claimed in claim 1 wherein the crossbeam has a clearance of about 0.5 millimeter in relation to the shell.

4. A reel support as claimed in claim 1 wherein the crossbeam is in the form of a pipe.

5. A reel support as claimed in claim 1 wherein the crossbeam is shorter than the shell by at least the length of engagement of the pins into the shell.

6. A reel support as claimed in claim 1 wherein the pins have spigots which engage into the crossbeam.

7. In a reel support with devices which are in the form of pins and able to be moved in and out, which serve to accommodate at least one reel of paper, or the like, and which is wound on a central shell made of cardboard or the like, from which a strip of paper is capable of being unwound, the improvement comprises:

a crossbeam having a modulus of elasticity similar to that of steel and having a weight which is approximately 4.5 to 6.5 times lower than would be the weight of steel having a similar mass, with the crossbeam being capable of insertion into said shell, said crossbeam further acting as an electric bridge with a switching network which includes a low-voltage circuit passing over it so that a drive is able to be passivated when said crossbeam is missing.

8. A reel support as claimed in claim 7, wherein the drive is a drive of the reel.

9. A reel support as claimed in claim 7, wherein the drive is a drive of the reel support.

10. A reel support as claimed in claim 7, wherein the drive is a drive of a successive printing press.

11. A reel support as claimed in claim 7, wherein said switching network contains said crossbeam as said electric bridge, said reel support further comprising:

a signal device; and, an interruption device which operates at a certain delay to said signal device, said interruption device serving to switch off a drive is capable of being activated by means of said switching network when said crossbeam is missing.

12. A reel support as claimed in claim 11, wherein the drive is a drive of the reel.

13. A reel support as claimed in claim 11, wherein the drive is a drive of the reel support.

14. A reel support as claimed in claim 11, wherein the drive is a drive of a successive printing press.

15. A process for the smooth and steady operation of a rotating-roll printing press, wherein a reel support with devices which are in the form of pins and able to be moved in and out, which serve to accommodate at least one reel of paper, or the like, and which is wound on a central shell made of cardboard or the like, from which a strip of paper is capable of being unwound, comprises the step of:

inserting a crossbeam into said shell which has a modulus of elasticity similar to that of steel and having a weight which is approximately 4.5 to 6.5 times lower than would be the weight of steel having a similar mass.

16. A process as claimed in claim 15 wherein the crossbar is made of carbon filament reinforced plastic.

17. A process as claimed in claim 15 wherein the crossbeam has a clearance of about 0.5 millimeter in relation to the shell.

18. A process as claimed in claim 15 wherein the crossbeam is in the form of a pipe.

19. A process as claimed in claim 15 wherein the crossbeam is shorter than the shell by at least the length of engagement of the pins into the shell.

20. A process as claimed in claim 15 wherein the pins have spigots which engage into the crossbeam.

* * * * *